United States Patent [19]

Thorpe

[11] Patent Number: 4,576,247

[45] Date of Patent: Mar. 18, 1986

[54] LOCKING MEMBER

[75] Inventor: Denis Thorpe, Titahi Bay, New Zealand

[73] Assignee: Development Finance Corporation of New Zealand, Wellington, New Zealand

[21] Appl. No.: 534,831

[22] Filed: Sep. 22, 1983

[51] Int. Cl.[4] ..... F01N 7/18

[52] U.S. Cl. ..... 181/243; 285/DIG. 22

[58] Field of Search ..... 181/241, 243, 227, 282; 285/80, 235, 236, 405-407, 420, 137 R, 158, 189, 192, 222, 382.4, DIG. 22

[56] References Cited

U.S. PATENT DOCUMENTS

| | | | |
|---|---|---|---|
| 1,995,840 | 3/1935 | Compo | 285/189 |
| 3,498,407 | 3/1970 | Straw | 181/282 |
| 3,608,667 | 9/1971 | Foster | 181/282 |
| 3,844,588 | 10/1974 | Jocsak | 285/DIG. 22 X |
| 3,964,570 | 6/1976 | Morrow | 181/268 |
| 4,164,255 | 8/1979 | Binet et al. | 285/158 X |
| 4,192,531 | 3/1980 | Williams et al. | 285/222 |
| 4,294,476 | 10/1981 | Nash | 285/189 |

FOREIGN PATENT DOCUMENTS 519708 7/1977 Australia .

*Primary Examiner*—Benjamin R. Fuller

*Attorney, Agent, or Firm*—Scully, Scott, Murphy & Presser

[57] ABSTRACT

A locking member 1 in the form of a collar can provide a strong mechanical joint between a tube 5 and an apertured plate 6. The locking member 1 has an outwardly directed flange 2 and an inwardly directed flange 4 and is accommodated on the end of the tube 5 which is then inserted in the aperture in the plate 6. Axial pressure applied to the end of the tube 5 will result in the deformation of the locking member and the tube end about the plate aperture resulting in a strong mechanical joint being formed between the tube 5 and the plate 6.

6 Claims, 7 Drawing Figures

LOCKING MEMBER

BACKGROUND OF INVENTION

This invention relates to a locking member in the form of a collar which can provide a strong mechanical joint between a tube and an apertured plate.

The present invention will be hereinafter described particularly with regard to its application in the construction of muffler assemblies for car silencers. It is, however, to be appreciated that this application is given by way of example only and that numerous other applications are possible and will be readily apparent to those skilled in the Engineering arts.

To the present time, the construction of muffler assemblies for vehicle silencers has usually required extensive welding between the various components thereof and particularly between the tubes and the baffles. This welding is time consuming and tends to assist in the development of corrosion around the weld points. It also tends to result in time in the failure of a percentage of the welds requiring the replacement of the entire silencer. Also, to facilitate such welding, the baffles have in the past been generally provided with flanges around the apertures to which the tubes are then inserted. This flange formation also increases the number of operations in the construction of a welded muffler assembly and hence the end cost thereof.

A proposal has now been put forward which allows a non-welded construction in which muffler tubes are expanded to form a ridge on each side of the baffle or end cap collar aperture to hold the muffler tubes to those parts. However, this proposal still requires the baffle or end cap apertures to be extruded or flanged with the resultant need for accurate preassembly before the muffler tube is expanded to form the resultant joint. Also, because the muffler tube is not expanded inside the flange area the baffle will only be as tight as the original, slide, fit.

The present invention has been developed specifically for use in the construction of mufflers but as it will be appreciated hereinafter it could be utilized in numerous other applications and wherever a mechanical joint between a tube and a plate is required.

It is thus an object of the present invention to provide a method and means whereby a strong mechanical joint between a tube and a plate can be obtained.

SUMMARY OF THE INVENTION

According to one embodiment of the present invention there is thus provided a method of securing a tube within an aperture in a plate, said method comprising:

(a) Providing a collar having first and second spaced apart flange portions;

(b) Introducing said collar onto a free end of the tube so that a first of said flange portions seats on and overlaps said free end;

(c) Introducing said free end of said tube and said collar into and through said aperture in said plate so that said second flange portion seats behind a rear rim of said aperture;

(d) Applying a force into said tube to deform said collar and to expand said free end so that said deformed collar is secured both to said expanded free end and the material of said plate about said aperture to form a mechanical joint between said tube and said plate.

According to a further embodiment of the present invention there is also provided a locking member for the above-defined method comprising a collar with a side wall portion of a substantially circular cross-section having a peripheral inwardly directed first flange portion at one end thereof and a peripheral outwardly extending second flange portion at an opposite end thereof, said first flange portion being deformable by axial pressure applied thereto so as to be capable of forming a joint with a free end of a tube on which said collar, before deformation, has been positioned.

According to yet a further embodiment of the invention there is also provided a muffler including at least one muffler tube, at least one end of said tube having a baffle plate secured thereto by a mechanical joint formed about an aperture in said baffle plate by a deformed locking collar, said locking collar before deformation having a side wall with a substantially circular cross-section connecting spaced apart first and second flanges, said locking collar after deformation having said first flange deformed with said one end of said tube secured against one side of said baffle plate and said second flange secured against the other side of said baffle plate.

BRIEF DESCRIPTION OF THE DRAWINGS

The present invention will now be described by way of example and with reference to the accompanying drawings wherein.

DETAILED DESCRIPTION OF THE PREFERRED EMBODIMENTS

Figure 1:
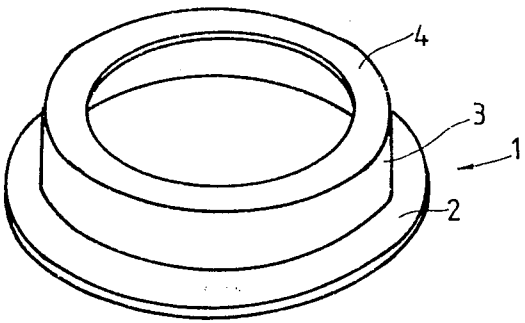
FIGS. 1 and 1A: show, diagramatically, repective plan perspective and cross-sectional views of a locking member according to one embodiment of the invention.
Figure 1A:
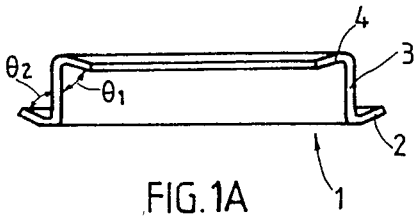

Referring to FIGS. 1 and 1A of the accompanying drawings, a locking collar 1 according to one embodiment of the invention has a substantially circular side wall portion 3 with at one end a peripheral inwardly directed flange portion 4 and at an opposite end a peripheral outwardly directed flange portion 2.

The collar 1 when used in the construction of muffler assemblies would generally be a non-corrosive metal e.g. stainless steel, of suitable gauge e.g. 20 or 18 bg. Alternatively, it could be of mild steel coated so as to protect against corrosion or plain mild steel but it should be of the same material or have the same coating as the other components to avoid setting up electrolytic action.

The inner and outer flanges 4 and 2 are each, shown having an included angle $\theta_1$ and $\theta_2$, shown in FIG. 1A which is other than a right angle and may suitably be of the order of 70 degrees.

Figure 2A:
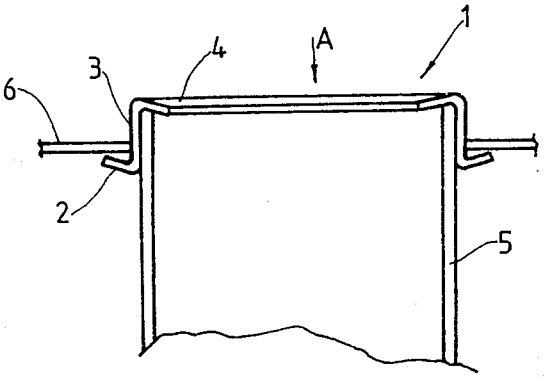
FIGS. 2A and 2B: show, diagramatically, cross-sectional views through a tube, collar and plate assembly both prior and after physical jointing there between has been obtained.

In FIG. 2A the collar 1 is shown positioned at the free end of a tube 5 which has then been inserted into an aperture in a plate 6. The flange 2 is shown positioned behind the underside of the plate 6 about the aperture therein, with the flange 4 seating on and extending over the free end of the tube 5.

Axial pressure by means of a suitable mandrel or other such member inserted into the end of the tube 5 in a direction indicated by arrow A is then applied. This will result in a desired physical joint between the tube 5 and the plate 6 being formed. Thus in FIG. 2B it will be seen that the axial pressure has resulted in the bell-mouthing or expanding of the tube free end 5A. At the same time the flange 4 has been forced inwardly to form a rim 10 which conforms with and grips the bell-mouthed tube end 5A. The side wall 3 is also shown conforming with the exterior surface of the tube end 5A before reaching the lower flange 2. The plate material around the plate aperture is thus trapped between the side wall 3 and the lower flange 2.

In this way, a strong mechanical joint is formed between the tube 5 and the plate 6 with the deformation of the tube end 5A and the collar 1.

The provision of the included angle $\theta_1$ defined by the flange 4 with the side wall 3 provides a leadin for the tube 8. The included angle $\theta_2$ defined by the outer flange 2 is however believed to contribute to the resulting joint obtained as described below.

Figure 2B:
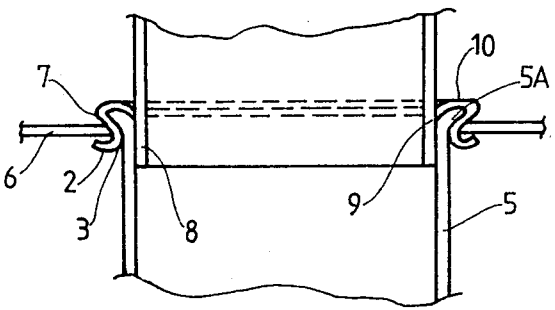

As the collar 1 is a "drawn" part there is inevitably a radius of a minimum of metal thickness between the flange 2 and the inner side of the wall 3. The bend in the flange 2 effectively lowers the reaction point against the tube 5 and prevents "twisting" of the collar 1 as the axial force A is applied. Without the provision of the bend in the flange 2 it is envisaged that the collar 1 could twist around the edge of the aperture in the plate 6. This could provide an inferior joint at least in its appearance. As shown in FIG. 2B the edge 9 of rim 10 formed by the deformed flange 4, will clear a tube 8 inserted into the tube 5 after the joint has been formed, the deformation of the tube 5 at its free end region 5A providing a lead-in for the tube 8.

Figure 3:
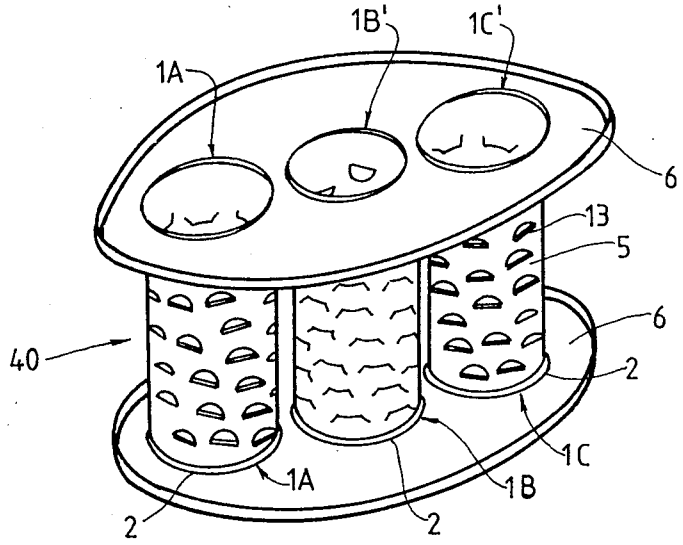
FIG. 3: shows, diagramatically, a muffler sub-assembly utilizing the present invention.

In FIG. 3, the present invention as described broadly in FIGS. 1, 1A, 2A and 2B is shown applied to the formation of a muffler-assembly 40. In FIG. 3 the baffle plates 6 have respective muffler tubes 5 secured thereto and there between at their respective ends by locking collars 1A, 1B, 1C and 1A', 1B' and 1C'.

Such muffler sub-assemblies 40 can then be connected to the end caps as required, either utilizing end connectors to form the desired length of silencer or by adjusting inlet and/or outlet tube lengths and diameters to mate with the assembly. The sub-assmebly 40 is tightly push-fit into an outer case of a barrel so that no welding is necessary.

The tubes 5 along their respective lengths are shown provided with a plurality of exhaust gas apertures or louvres 13 in a known manner.

To construct the sub-assembly 40, collars will be mounted at each end of tube 5 and the collars 1 and the tube ends will then be inserted into respective apertures in the baffle plates 6. A pressing operation will then be effected whereby the mechanical joints such as illustrated in FIG. 2B will be formed between the tube ends and the baffle plates 6 by means of the respective collars 1 simultaneously.

Figure 4:
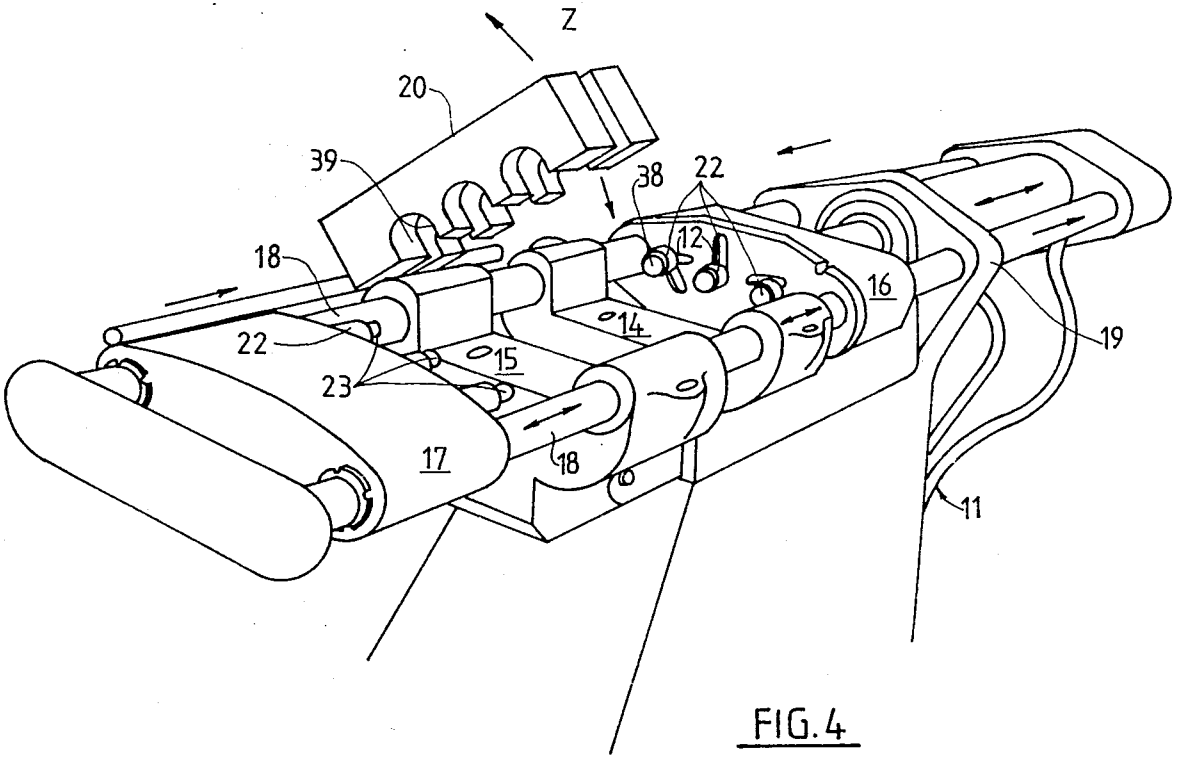
FIG. 4: shows, diagramatically, an hydraulic press assembly suitable for carrying out the manufacture of the muffler assembly of FIG. 3.

In FIG. 4, a press assembly is indicated generally by arrow 11 which could be used for forming a muffler sub-assembly such as illustrated in FIG. 3 or the complete muffler shown in FIG. 5 hereinafter described.

The press 11 is shown including lower anvils 14 and 15 on which a sub-assembly such as shown in FIG. 3 can be positioned prior to the mechanical joints therein being formed. An upper anvil 20 is movable in a vertical plane as illustrated by arrow Z so as to close over the lower anvils 14 and 15. The anvil 20 is shown provided with recesses 39 so as to accommodate the curvature of the respective tubes 5. The closing of the anvil 20 over the sub-assembly 40 can activate the press sequence wherein anvil 14 can move away from anvil 15 by a small pre-determined distance, for example 0.5", and can then be locked, in a position whereby the flanges 2 of the collars 1 are supported avoiding compressive stress on the tubes 5.

A ram 16 can then move towards the anvil 20 until the mandrels 38 engage with the respective collars 1 mounted on the ends of the tubes 5 and to cause axial pressure to be exerted thereon thus forming the joints between the tubes 5 and the baffles 6. Spring loaded collars 22 about the respective mandrels 38 can assist in maintaining the collars, tubes and baffle plate in the desired position relative one with the other as the joints are formed. The resistance offered by the baffle sub-assembly can then cause pressure to be exerted on the bars 18 resulting in the closure of the distance between the end member 17 and the anvil 15. Pressure can continue to be exerted on the baffle sub-assembly until its component parts have been physically joined together when the ram 16 can return to a stop on an end member 19. The bars 18 can then push the end member 17 away and a spring (not shown) which can be provided under the ram 16 can operate the anvil 14 to retract it back towards the anvil 15 by the aforementioned distance it first moved away. The top anvil 20 can then automatically lift up and the finished muffler sub-assembly removed. The total time taken may be of the order of 30 seconds.

The mandrels 23 adjacent the end member 17 are also shown provided with spring loaded collars 22 for the aforementioned purpose.

The mandrels 22 and 23 are also each shown provided in the respective end members of the press with slots 12 which can enable vertical and horizontal adjustment of the mandrels prior to locking so as to accommodate various locations of apertures in the baffle plates of the sub-assembly.

Additionally, various adjustments can be made to accommodate required lengths of sub-assemblies 40 which may be required to be formed.

If the jointing of the tubes 5 to a single baffle plate 6 only were required then the bars 18 could be locked relative to the anvil 15 in which case only the ram 16 would be operable.

It is to be appreciated that the press assembly shown in FIG. 4 is by way of a very diagrammatic illustration only of a type of press suitable for achieving the desired mechanical joints in a muffler or other required assembly or sub-assembly.

It will also be appreciated, however, that by utilizing the present invention a plurality of tubes 5 can be inserted into and locked with an apertured plate 6 at one or both ends thus avoiding individual insertion and welding as used at the present time. Also the use of extruded or flanged apertures in the baffle plate are no longer required. Moreover, the resulting mechanical joints are believed to be more rigid and superior to welded joints and furthermore avoid corrosion around the joints due to material deterioration caused firstly by swaging and then by welding.

Figure 5:
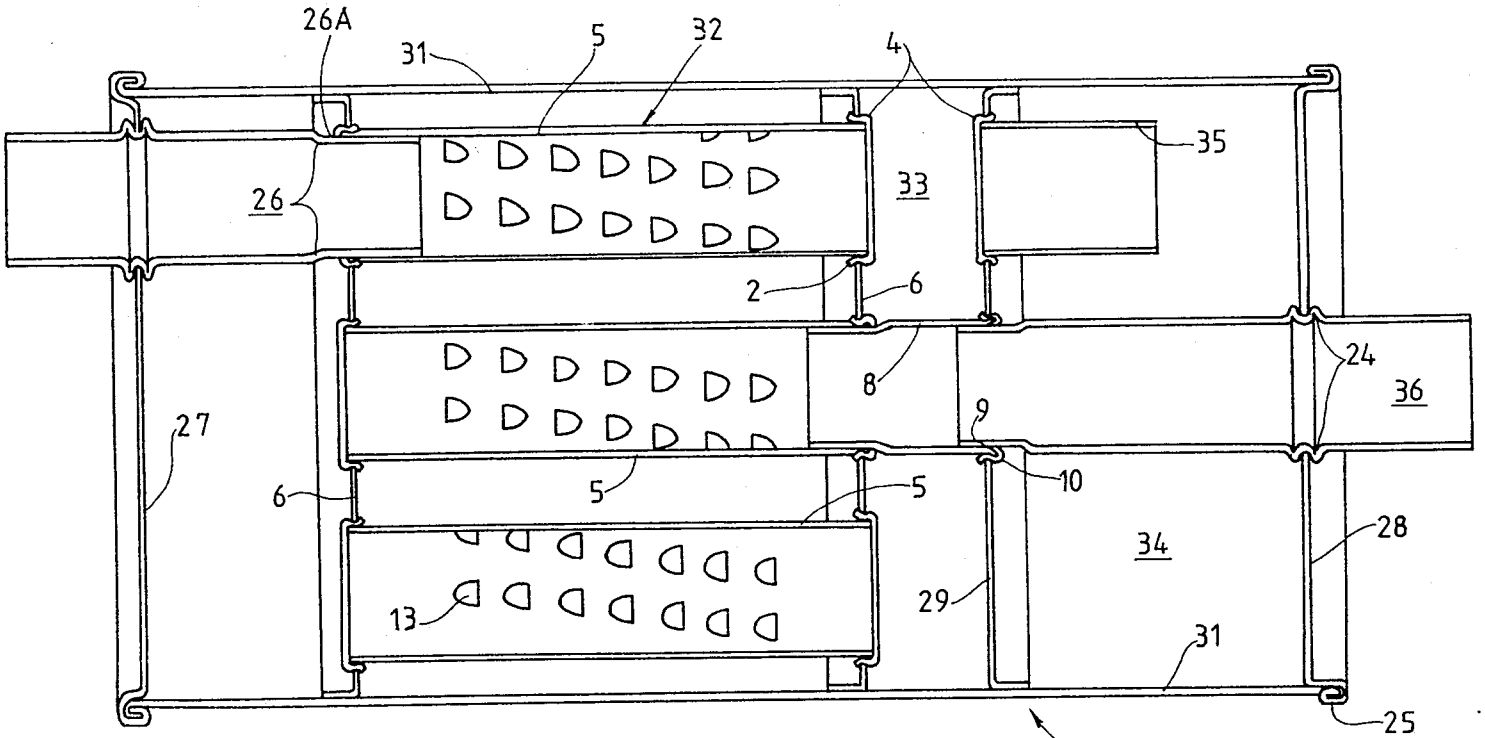
FIG. 5: shows, diagramatically, a cross-sectional view of a muffler utilizing the present invention.

Referring now to FIG. 5 of the accompanying drawings a complete muffler assembly is illustrated in cross-section and referenced generally by arrow 30.

The muffler 30 is shown having a barrel 31 with respective end caps 27 and 28 secured thereto. The inlet tube 26 is shown extending through and secured to an end cap 27 and with a reduced diameter portion 26A extending into the muffler sub-assembly 32 and more particularly into one of the louvred tubes 5 thereof. Each of the tubes 5 of the sub-assembly 32 is shown jointed at each end with the respective apertured baffle plates 6 by means of respective collars 1.

Similarly, plate 29 defines with one of the baffle plates 6 and an end cap 28 respectively a reversing chamber 33 and a Helmholtz chamber 34. A tuning tube 35 is shown extending through and connected with the plate 29 by means of a collar 1. The exhaust gas exiting from the sub-assembly 32 through exhaust tube 36. The inlet and outlet tubes 26 and 36 are shown connected with the respective end caps 27 and 28 by a non-crimping technique forming joints 24 whilst the end caps 27 and 28 are shown respectively connected with the barrel 31 by means of lock seamed rolled joints 25, no welding being required in this whole assembly.

The various rigidly locked and accurately aligned but rapidly built sub-assemblies can become the building blocks of a highly efficient modular manufacturing concept. The resultant product is completely weld free to the stage shown in FIG. 5. Welding may be required for attachments only, for example extension pipes or brackets.

Where in the aforegoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope of the invention as defined in the appended claims.

I claim:

1. A muffler including:

a baffle plate having at least one aperture;

at least one muffler tube extending into the aperture in the baffle plate; and a locking collar formed separately from both the baffle plate and the muffler tube, and connecting the muffler tube to the baffle plate, the locking collar including a side wall of a substantially circular cross section located between the plate and the tube, a first flange extending inwardly from a first end of the side wall, deformed over a first end of the tube, and capturing the first end of the tube between the side wall and the first flange thereby to mechanically join the tube to the locking collar, and a second flange spaced from the first flange, extending outward from a second end of the side wall, seating against the plate, and capturing the plate between the second flange and the side wall thereby to mechanically join the plate to the locking collar.

2. A muffler according to claim 1 wherein said first and second flanges each define an included angle with said side wall which is other than a right angle.

3. A muffler according to claim 2 wherein said included angles are each substantially 70 degrees.

4. A muffler according to claim 1 wherein the second flang extends upwardly outwardly from the side wall, and the second flange includes:

an inside portion forming a bend with the side wall; and an outside edge engaging the baffle plate and holding said bend spaced from the baffle plate.

5. A muffler according to claim 4 wherein:

a top edge of the tube flairs outward above the baffle plate;

the sidewall flairs outwardly above the baffle plate, and the sidewall includes a first portion extending below the edge of the tube, and a second portion extending outside said top edge; and the first flange extends inward from the second portion of the sidewall, over the top edge of the tube, and captures said top edge between the first portion of the sidewall and the first flange.

6. A muffler according to claim 5 wherein the locking collar prevents axial movement of the muffler tube relative to the baffle plate.

* * * * *